United States Patent [19]

Gregor et al.

[11] Patent Number: 5,046,413

[45] Date of Patent: Sep. 10, 1991

[54] METHOD AND APPARATUS FOR BAND PRINTING WITH AUTOMATIC HOME COMPENSATION

[75] Inventors: John S. Gregor, Endicott; Clarence C. Hubbell, Vestal; Susan K. Lichtensteiger, Endicott, all of N.Y.

[73] Assignee: International Business Machines Corp., Armonk, N.Y.

[21] Appl. No.: 593,138

[22] Filed: Oct. 5, 1990

[51] Int. Cl.[5] ..... B41J 1/20

[52] U.S. Cl. ..... 101/93.01; 101/93.03; 101/93.13; 400/146; 400/157.2; 400/157.3; 400/166; 364/519

[58] Field of Search ..... 101/93.01, 93.03, 93.14, 101/111; 400/146, 157.2, 157.3, 166; 364/519

[56] References Cited

U.S. PATENT DOCUMENTS

| | | | |
|---|---|---|---|
| 3,789,971 | 2/1974 | Deyesso et al. | 400/154.3 |
| 3,866,533 | 2/1975 | Gilbert et al. | 101/93.03 |
| 3,987,723 | 10/1976 | Mahoney et al. | 101/93.14 |
| 4,122,769 | 10/1978 | Sery et al. | 400/146 |
| 4,317,412 | 3/1982 | Bolcavage et al. | 101/93.01 |
| 4,368,666 | 1/1983 | Kozawa et al. | 101/93.01 |
| 4,384,520 | 5/1983 | Nakano et al. | 400/157.3 |
| 4,407,193 | 10/1983 | Hall et al. | 101/93.01 |
| 4,428,286 | 1/1984 | DeSager et al. | 400/146 |
| 4,527,920 | 7/1985 | Mako | 400/146 |
| 4,597,328 | 7/1986 | Carrington et al. | 101/93.13 |
| 4,649,501 | 3/1987 | Bloom et al. | 400/146 |
| 4,664,543 | 5/1987 | Bohg et al. | 101/93.13 |
| 4,679,169 | 7/1987 | Salle et al. | 364/519 |
| 4,764,039 | 8/1988 | Bublitz | 400/146 |
| 4,806,031 | 2/1989 | Amdahl et al. | 101/93.03 |
| 4,821,639 | 4/1989 | Carrington et al. | 400/146 |

*Primary Examiner*—Eugene H. Eickholt
*Attorney, Agent, or Firm*—John S. Gasper

[57] ABSTRACT

A system and method for automatically compensating for inaccuracies in the positioning of the timing mark sensor of a band line printer. A selected hammer is operated to impact a test character and an adjacent space between characters or a space provided by a blank character on the type band. The flight times of the hammer for the character and space impacts are measured under control of a microprocessor programmed to locate the edge of the test character and to compute a timing adjustment value for use by the printer control to obtain centered impacts of characters during printing.

13 Claims, 7 Drawing Sheets

METHOD AND APPARATUS FOR BAND PRINTING WITH AUTOMATIC HOME COMPENSATION

FIELD OF THE INVENTION

This invention relates to a impact printers and particularly to a control system and method for adjusting the timing signals used for operating the print hammers of impact line printers.

BACKGROUND OF THE INVENTION

Impact line printers comprise an endless type carrier, such as a band or belt with etched characters, revolving at constant speed past a row of electrically operable print hammers. An electronic control system selectively actuates the print hammers in synchronism with the motion of the type carrier to impact a print medium against selected characters as they come into alignment with selected print hammers. The quality of printing depends on accurately timing the hammer impact with the alignment of the selected character at the selected hammer position.

The type band commonly has timing marks that physically locate each character on the band. They also have a reference or "home" mark that identifies which character timing mark is the start of the band. The timing mark following the home mark is the home character timing mark. Sensors read the timing and home marks. A single sensor may be used if the home mark is embedded in the timing mark track. Due to space constraints associated with the hammer unit assembly, the band drive mechanism and the paper feed carriage mechanism, the sensors are not usually located at the home hammer position. Therefore, the home character, i.e. the character physically located by the home timing mark, is displaced from the home timing mark by the distance between the home hammer and the timing mark sensor. This distance varies from printer to printer by the accumulated tolerances derived in the manufacturing processes of the hammer unit, the band drive mechanism, the band and the sensors.

The timing mark sensors, including the home mark sensor if separate, must be adjusted until the correct characters are printing in the correct hammer positions. This is done by adjusting the sensed home pulse until it accurately indicates when the home character is correctly positioned to be struck by the home hammer (true home). True home cannot be calculated without actually knowing where the print hammer is striking the band. Sensed home is adjusted by adding a delay equal to the difference between sense home and true home (home pulse delay). One way the adjustment can be made is by having a fixed home pulse delay and mechanically moving the sensor until home pulse delay is correct. U.S. Pat. No. 3,987,723 describes a sensor adjustment mechanism. Other mechanisms may be seen on commercially available printers such as the IBM 3262, 4245 and 4248 line printers.

Another way for adjusting the sensed home is by printing a test pattern and visually observing the characters printed. If the test pattern looks as if it is off center, the home pulse delay is changed until the test pattern looks correct by manipulating an input device such as an operator panel which inserts a delay value adjustment into the control electronics of the system. U.S. Pat. No. 4,368,666 shows another method of adjusting print hammer timing which involves manual adjustment of circuit parameters of the hammer operating circuits to compensate for the interval from the detection of the timing mark and the energization of the hammer electromagnet.

A problem with the mechanical adjustment method is its increased cost factor. In addition, it is time consuming and the accuracy achieved is dependent on the manual and visual skills of an operator to produce the right setting of the mark sensor. The problem with the test pattern method is that it is to large extent subjective and requires manipulation of an operator panel.

SUMMARY OF THE INVENTION

The invention overcomes the above problems by providing a system and method which automatically adjusts the timing of the sensed home pulse and thereby eliminates the need for mechanically adjusting the location of the timing mark sensor or other manual intervention. Basically the invention achieves this by providing a system and method which finds the actual strike point of a given print hammer on a specific character. More specifically, the hammer is operated a number of times to impact a specific character, each time with a longer delay of the hammer fire time, until the edge of the specific character is located. This is done by measuring the flight time each time the hammer is operated and determining from the accumulated measurements, when the hammer strikes just past the edge of the character. Flight time measurement is performed using an impact detection means which in the preferred embodiment comprises a transducer platen located behind the type band in combination with timing circuits. The operation of the print hammer is initiated by the control system in response to a timing pulse generated by the timing mark sensor, the firing of the hammer being delayed by a home pulse delay value which assures impact of the specific character. The home pulse delay value is then adjusted in a series of increments to thereby cause the hammer to impact the specific character at different strike points until it eventually misses impacting the specific character. The flight times of the hammer are measured using the flight time circuits and impact detection means each time the hammer is fired and the flight measurements used to locate the edge of the specific character. A home pulse delay value adjustment is then derived based on the difference in the measured hammer flight times when the edge of the character is being struck and when the edge is just missed. The home pulse delay value adjustment is then stored and used by the control system for timing the operation of the print hammers to compensate for the offset of the timing mark sensor from the correct sensor position to thereby insure that the hammer striking point of all the hammers is thereafter at the center point of each character.

Since all print times are calculated from the home character, any character or any hammer can be used to determine the edge of the character. To ensure the flight time difference is sufficiently great so as to be detectable, a character followed by either a blank or missing character or a small character is selected for finding the hammer strike point. This enables the hammer to strike between the projecting characters and thereby produces a detectably longer hammer flight time. The blank or small character could also be leading the selected character, but hammer damage may occur if the leading edge of the following selected character strikes the side of the hammer before the hammer rebounds. In this manner a printer system control and method of operation is provided which enables accurate striking of moving characters on a print band and thereby enhances print quality. Costly and time consuming mechanical adjustments are eliminated and operator subjectivity is dispensed with.

The foregoing and other objects, features and advantages of the invention will be apparent from the following more particular description of a preferred embodiment of the invention, as illustrated in the accompanying drawing.

DETAILED DESCRIPTION OF THE INVENTION

Figure 1:
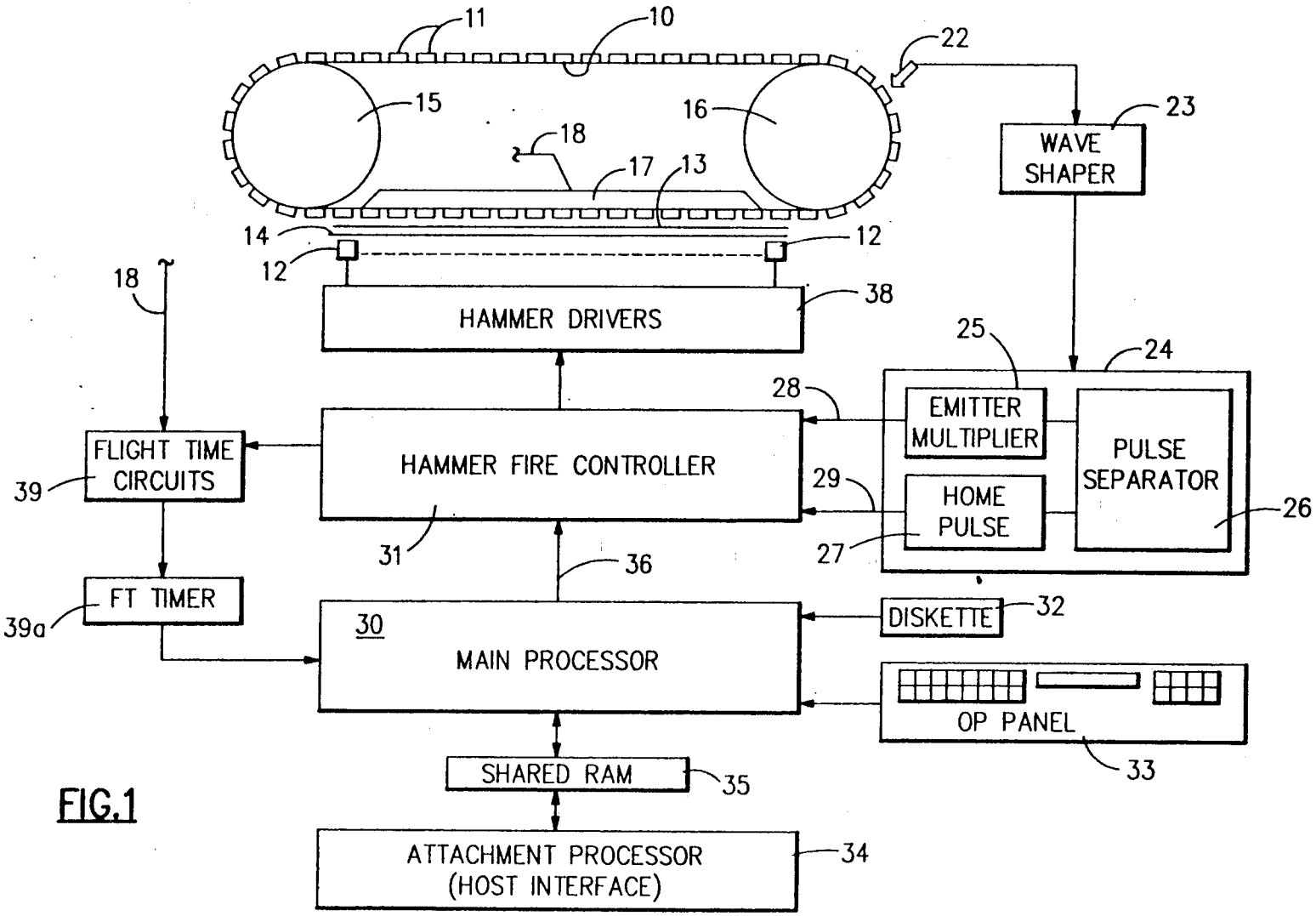
FIG. 1 is a schematic diagram describing a printer apparatus and control system practicing the invention.

Although the invention may be used with various types of impact printers, the detailed description will be made with relation to a high speed line printer having a steel band as the print type carrier. Referring to FIG. 1, in the preferred embodiment, the printer mechanism comprises a type band 10 having projecting etched or engraved characters 11 facing a row of uniformly spaced print hammers 12. A print medium comprising ink ribbon 13 and paper 14 is interposed between the type characters 11 and the print hammers 12. Ribbon 13 may be a bed sheet type fed between a pair of rolls (not shown). Paper 14 may be a continuous web fed by tractor mechanisms operated by a suitable motor (not shown). Type band 10 is rotatably supported on spaced drive pulleys 15 and 16. A motor (not shown) is connected to one of the pulleys and operates to revolve the type band in a fixed direction and at a constant speed throughout the printing operation.

Characters 11 are uniformly spaced on band 10 but at a pitch which differs from the pitch of hammers 12. Because of the pitch differential of the characters 11 and hammers 12, the characters 11 align individually with individual hammers 12 in sequence during intervals known as scans. During the course of a scan interval, several different characters 11 come into alignment with hammers 12.

Print hammers 12 may be of any type but in general are commonly an electromagnetic actuator which impels a hammer element to impact the paper 14 and ink ribbon 13 against characters 11. Located behind type band 10 between pulleys 15 and 16 is platen 17 which is at least coextensive with the row of hammers 12. The purpose of platen 17 is to provide backup to type band 10 so as to limit the displacement of the type band when the print medium is impacted by the hammers. Platen 17 may take various forms but generally includes a back plate or block fixedly attached to the machine frame (not shown). In accordance with this invention, platen 17 is constructed so that impacts of the individual hammers 12 against characters 11 generate impact signals on line 18 which in combination with control signals for operating hammers 12, the flight time of any of the hammers 12 can be measured. Such a platen is referred to as a transducer platen.

Figure 3:
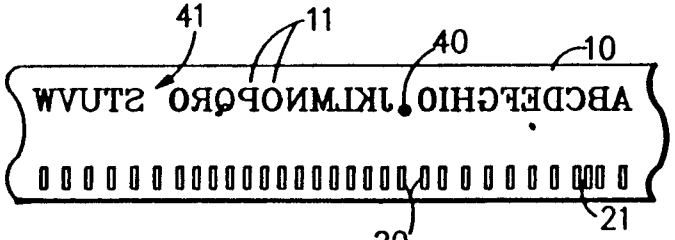
FIG. 3 is a plan view of a fragment of a type band usable in the printer apparatus of FIG. 1 for illustrating the arrangement of type for practicing the invention.
Figure 5:
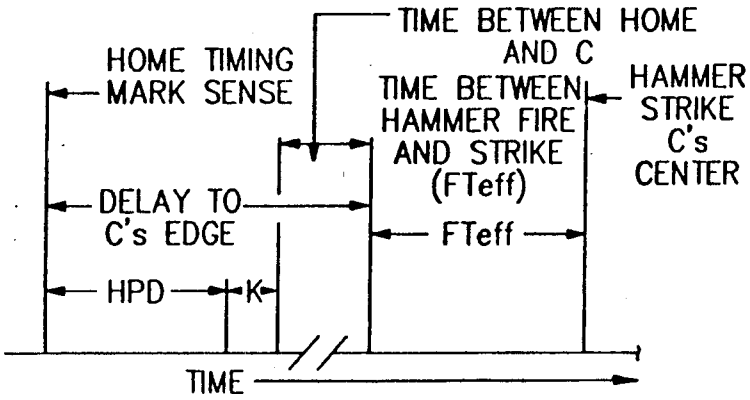

In order for such a printer mechanism to operate properly, timing and selection of hammers 12 is crucial. As seen in FIG. 3, type band 10 has timing marks 20 arranged in a row parallel with characters 11. The timing marks 20 are equal in number to and are aligned with the type characters 11. A home mark 21 is located in the same row between two timing marks 20. Timing marks 20 and home mark 21 may also be etched or engraved. Timing marks 20 and home mark 21 are sensed during motion of type band 10 by an electromagnetic sensor 22 which generates detection signals commonly called emitter pulses. The emitter pulses are used for determining the printing times of each of the hammers 12. As previously mentioned, timing marks 20 serve to locate the characters 11. Home mark 21 serves to indicate that the following timing mark 20 is the home timing mark which in turn locates the reference character which is the start of the type band 10. Emitter pulses are passed through wave shaper 23 to timing circuits 24.

As shown in FIG. 1, sensor 22 is preferably positioned a fixed distance from the nearest hammer 12. The magnitude of this distance is arbitrary and is primarily selected on the basis of design convenience. However, positioning sensor 22 in this manner introduces some anomalies into the timing of the hammers 12 which varies from printer to printer and which require adjustment in order that the timing of the hammers assures accurate impacting of characters 11 by hammers 12. Included in timing circuits 24 is multiplier circuit 25 which converts each emitter pulse into a sequence of timing pulses used for timing various operations associated with hammer operation. Multiplier circuit 25 is preferably a phase locked loop and a free running oscillator which generate a fixed number of timing pulses, described hereinafter as ticks, in response to an emitter pulse. The number of ticks produced per emitter pulse is a matter of design choice but in the description to follow, the tick number is 128. Thus each scan interval is divided into 128 time subdivisions or tick intervals during which a hammer operation can be ordered. Timing circuit 24 also includes pulse separator circuit 26 which functions to distinguish a home emitter pulse from timing emitter pulses and turns on a single shot 27 or like circuit element which generates a timer synch pulse for synchronizing the timing circuitry of the control system at the beginning of printer operations as well as for periodically checking whether the band 10 and the printer electronics are operating in synchronism.

Further elements of the control system comprise main processor 30, hammer fire controller 31, diskette drive 32 and op panel 33. Main processor 30 which may be microprocessor such as the Intel 80186 receives data from a host system(not shown) through host interface 34. Included in interface 34 is an attachment processor operable for communicating with the host system to receive and store lines of data to be printed. The attachment processor, which also may be a microprocessor such as the Intel 8088, of interface 34 stores the print line data in shared RAM (random accessor memory) 35 for use by main processor 30. Shared RAM 35 includes a buffer sector commonly referred to in the art as the print line buffer (PLB) for storing one or more lines of data sent down from the host system to be printed. An electronic image of the type characters on band 10 is stored in diskette drive 32 along with control microcode and other data used by main processor 30 and includes the microcode and data used for operating hammers 12 to perform the flight time measurements in accordance with this invention. Op panel 33 comprises an optical display plus key elements used for various operations such as start up of the printer and for activating the main processor 30 to initiate the process of this invention.

As is well known, main processor 30 using various microcode routines generates data used by hammer controller 31 for the selection and operation of the individual hammers 12. Main processor 30 does this by comparing the line print data stored in the PLB sector of shared RAM 35 with the image of the characters on band 10 downloaded from diskette drive 32 and into a BIB (band image buffer) sector of its own memory to determine the address sequence in which the hammers are to be operated, calculating the time values at which hammers 12 are to be individually operated, and generating the control data which turns on drivers 38 at the appropriately determined times.

In calculating the time values for the various hammers 12, main processor 30 determines the tick time after the home timing emitter pulse at which a given character will be aligned with a desired hammer by taking into account the position of the characters 11 on band 10, their location at any given time relative to the home hammer position and the speed of band 10. In addition, the tick time determined by main processor 30 includes an adjustment value to the tick time values to compensate for the individual flight time variations of the hammers 12. Such flight time adjustment values are predeterminable at the time of printer manufacture and periodically during printer operation using flight time circuits 39 and flight time (FT) timer 39*a*. The predetermined flight time adjustment values are initially stored in diskette drive 32 and downloaded into a table in main processor 30. Flight timer 39*a* essentially comprises a counter of any well known type which counts timing pulses from a clock source (not shown). Flight timing is done under control of main processor 30 by the timer 39*a* being enabled by the hammer fire set signal produced by hammer controller 31 to turn on a selected hammer driver 38 and then being disabled in response to impact signals produced by transducer platen 17. The clock pulse count is stored and the flight timing process repeated any number of times and then followed by the calculation of an average flight time value by attachment processor 34. The average flight time value is then recorded in diskette drive 32 and in main microprocessor memory for subsequent use in calculating hammer tick timing values as described. In accordance with this invention, tick time values include a further adjustment value, hereinafter called a Home Emitter Delay (HED) value, derived by main processor 30 by performing flight time measurements using a test character to be described, said HED value being a value for adjusting the timing of all hammers which compensates for offsets of the sensor 22 from its correct position relative to the position of the home hammer 12.

Figure 4:
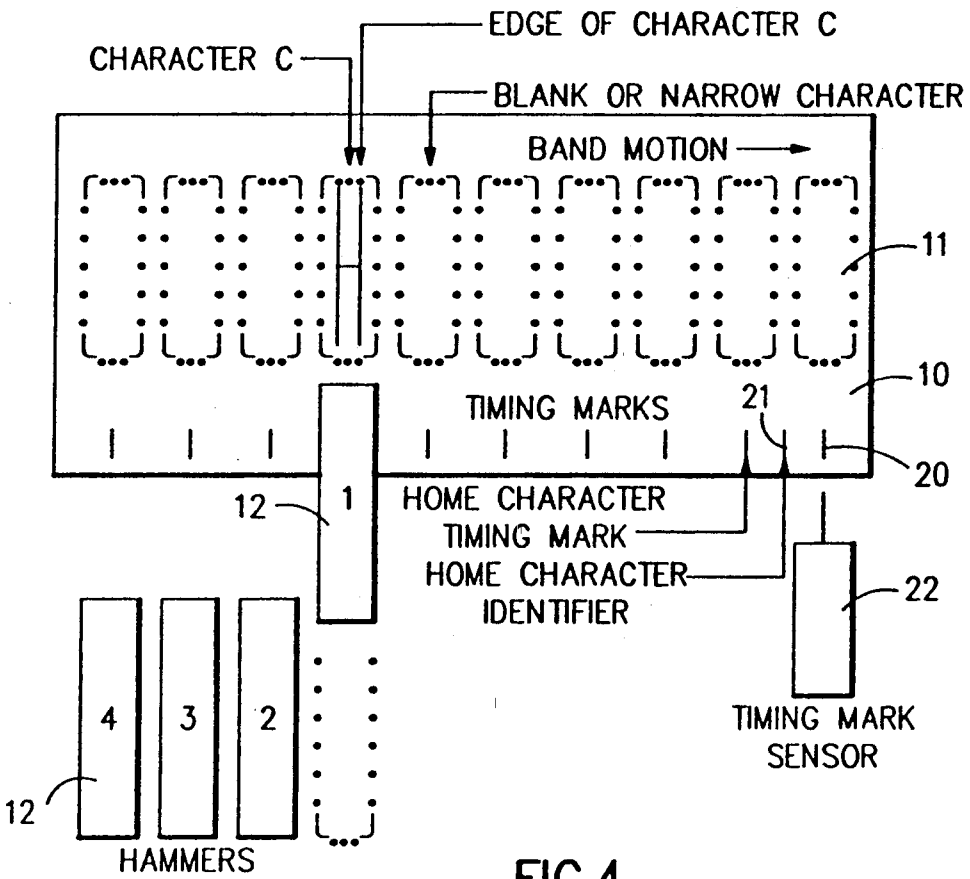
FIGS. 4, 5 and 6 are charts for explaining the flight time parameters for the hammers operated by the control system of FIG. 1.
Figure 6:
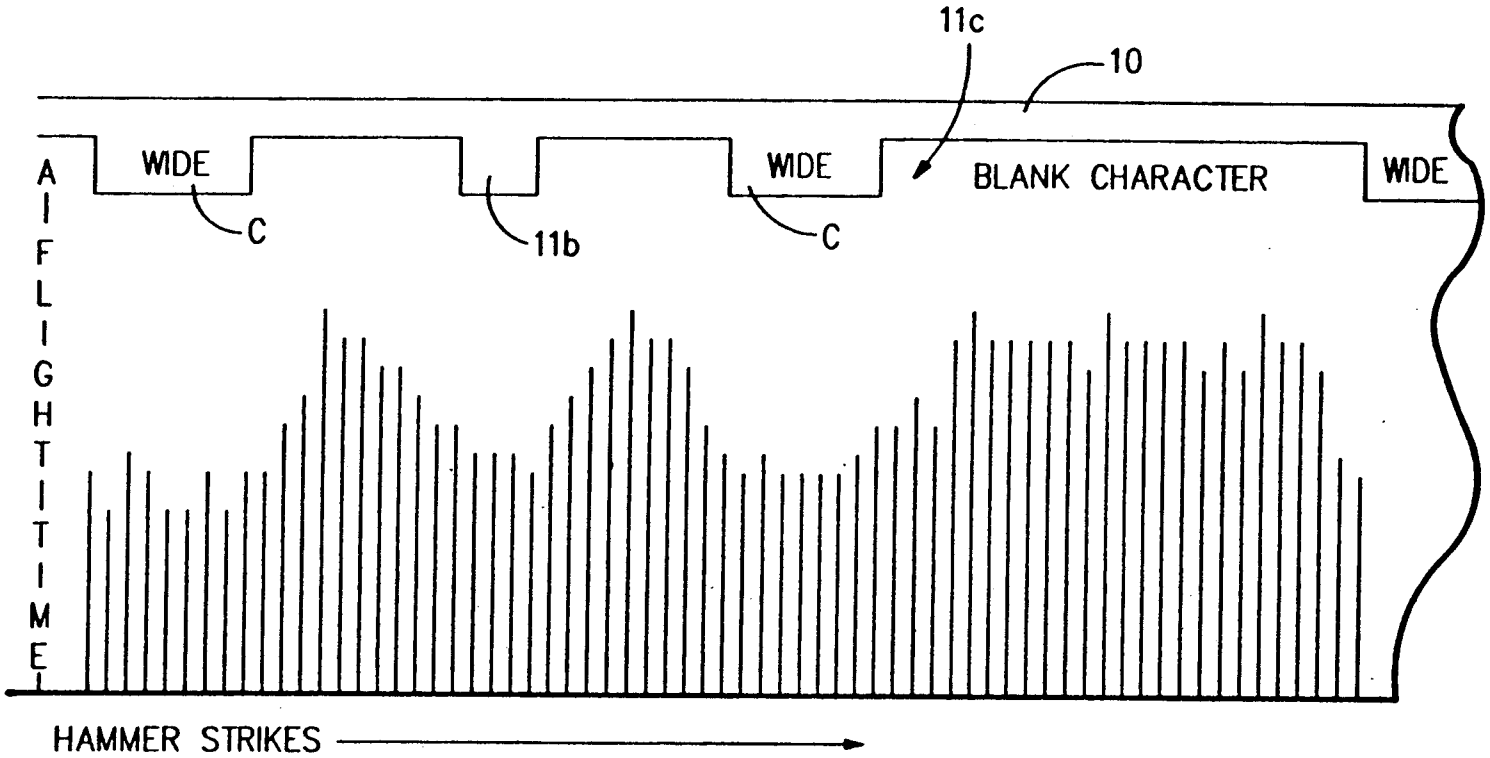

The hammer address, tick time value and control data is sent in bursts via bus 36 to the hammer fire controller 31 where it is stored and used to operate hammers 12 in synchronism with the movement of band 10. For the purpose of practicing this invention, main processor 30, in the same manner as for printing, and in accordance with microcode obtained from diskette 32 calculates the tick time value and hammer address of a specific character on band 10 selected as a test character. The test character need not be a special character but preferably is a wide character with well defined edges, such as H or 0, which is also useable otherwise for normal printing of data. The hammer selected as the test hammer can be any hammer 12 but most conveniently is the home hammer. As previously mentioned, the test character is preferably located on band 10 adjacent to a small character such as a period (.) 40. Alternatively, band 10 might be constructed to have a blank character (i.e. a blank space) 41 adjacent the character to be used as the test character. (see FIGS. 3 and 4). This enables the test hammer to impact band 10 between characters 11. As illustrated in FIG. 6, the flight times for hammer strikes of wide test characters C are readily differentiated from the flight times for hammer strikes between character C and small character 11*b* or blank character 11*c*.

Figure 2:
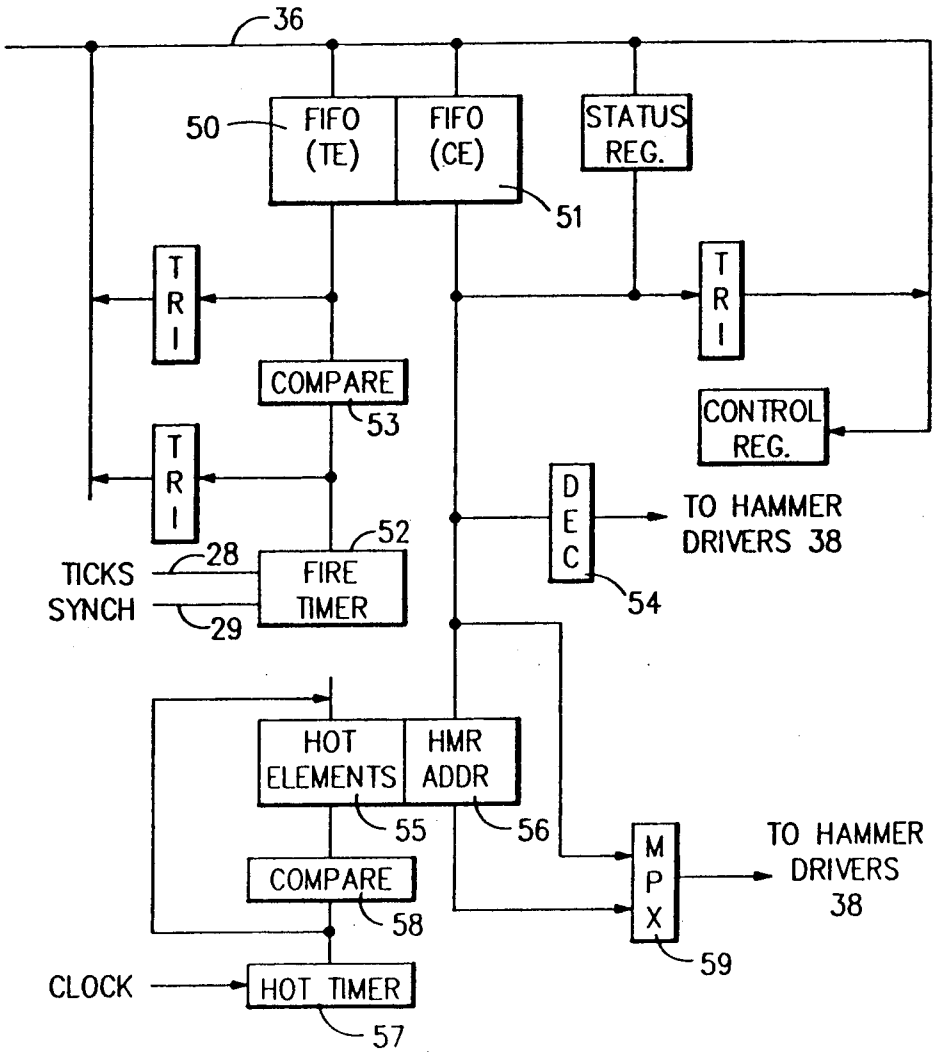
FIG. 2 is another schematic diagram showing details of the hammer timing portions of the system of FIG. 1.

The other functional portion of the printer control system comprises hammer controller 31. Referring to FIG. 2, hammer controller 31 comprises two multi-bit wide first in/first out (FIFO) memories 50 and 51. FIFO memory 50 stores time element (TE) data and FIFO memory 51 stores control element (CE) data. The TE data comprises the tick time values derived by main processor 30 at which designated hammers 12 are to be fired. The CE data comprises address data and control data, such as set, associated with TE data for firing the designated hammers 12. The TE and CE data are calculated by main processor 30 and loaded into FIFO 50 and 51 via bus 36.

Hammer controller 31 also includes fire timer 52 and compare circuit 53. Fire timer 52 counts ticks on line 28 from emitter multiplier 25 and is reset to zero by a timer synch pulse on line 29 from single shot 27 of timing circuit 24. The count capacity of fire timer 52 is large enough to count the total number of ticks generated by emitter multiplier 25 between the home emitter timing pulses. Fire timer 52 continuously counts tick pulses after initialization by main processor 30 at the beginning of printer operation and is repeatedly reset by the timer synch pulse so long as band 10 is in motion. Compare circuit 53 compares the count in fire timer 52 with tick time values read from FIFO 50. When the tick time value and the timer value are equal, the hammer address and control data is read from the related position in FIFO 51. The hammer address data read from FIFO 51 is applied through multiplexor 59 to hammer driver 38 controls. The control data is applied through decode 54 which produces a set signal (i.e a hammer fire pulse) which turns on the addressed hammer driver 38 to energize the addressed electromagnet of the addressed hammer 12.

Included in controller 31 are FIFO memories 55 and 56. FIFO memory 55 stores Hammer On time data and FIFO memory 56 stores hammer address data of hammers turned on by compare circuit 53. In this case the Hammer On Time (HOT) data is a predetermined fixed time value supplied by diskette drive 32 to main processor 30 for storage in FIFO 55. Hammer on time (HOT) timer 57 counts clock pulses. When the count in timer 57 is equal to the time value in FIFO memory 55, compare circuit 58 generates a reset signal which turns off the hammer 12 identified by the address data read from FIFO memory 56 through multiplexor 59. Further details of operation of the FIFO's for resetting are described in U.S. Pat. No. 4,679,169.

The following describes the sequence of operations for deriving the time values to compensate for offset errors in the location of sensor 22:

1. Determine the approximate position of the test character C (i.e. 11*a*) next to the small character 11*b* using a calculated home delay value. The distance between the true home position of sensor 22 and the test character C is done by comparisons of the PLB and BIB as previously described. The Home Emitter Delay Value (HEDV) is calculated using the distance the sensor 22 is displaced from the home hammer, the spacing of the timing marks 13 and the speed of band 10. This value can have two components, one being the number of complete timing mark intervals and the second being the portion of a timing mark interval needed to exactly correct the timing mark sensor to home hammer distance.

2. Calculate the average hammer flight time (FTa) to character C. FTa is derived by measuring a number of individual flight time (FT) samples, adding them and then dividing by the number of samples (FTSn). FTa=(FTS1+FTS2+ . . . +FTSn)/n.

3. Change HEDV and measure FT repeatedly until the edge of C is located. As seen in FIG. 6, the flight time (FTb) to the space between C and small character 11*b* or the blank character 11*c* is longer than the FT to C (FTc).

4. Change HEDV by one half the calculated width of C plus one half the width of the hammer 12. This will cause hammer 12 to strike exactly at the center of character C. The changed HEDV is then used to synchronize the BIB to the PLB and every character 11 will be struck at its center.

Figure 7:
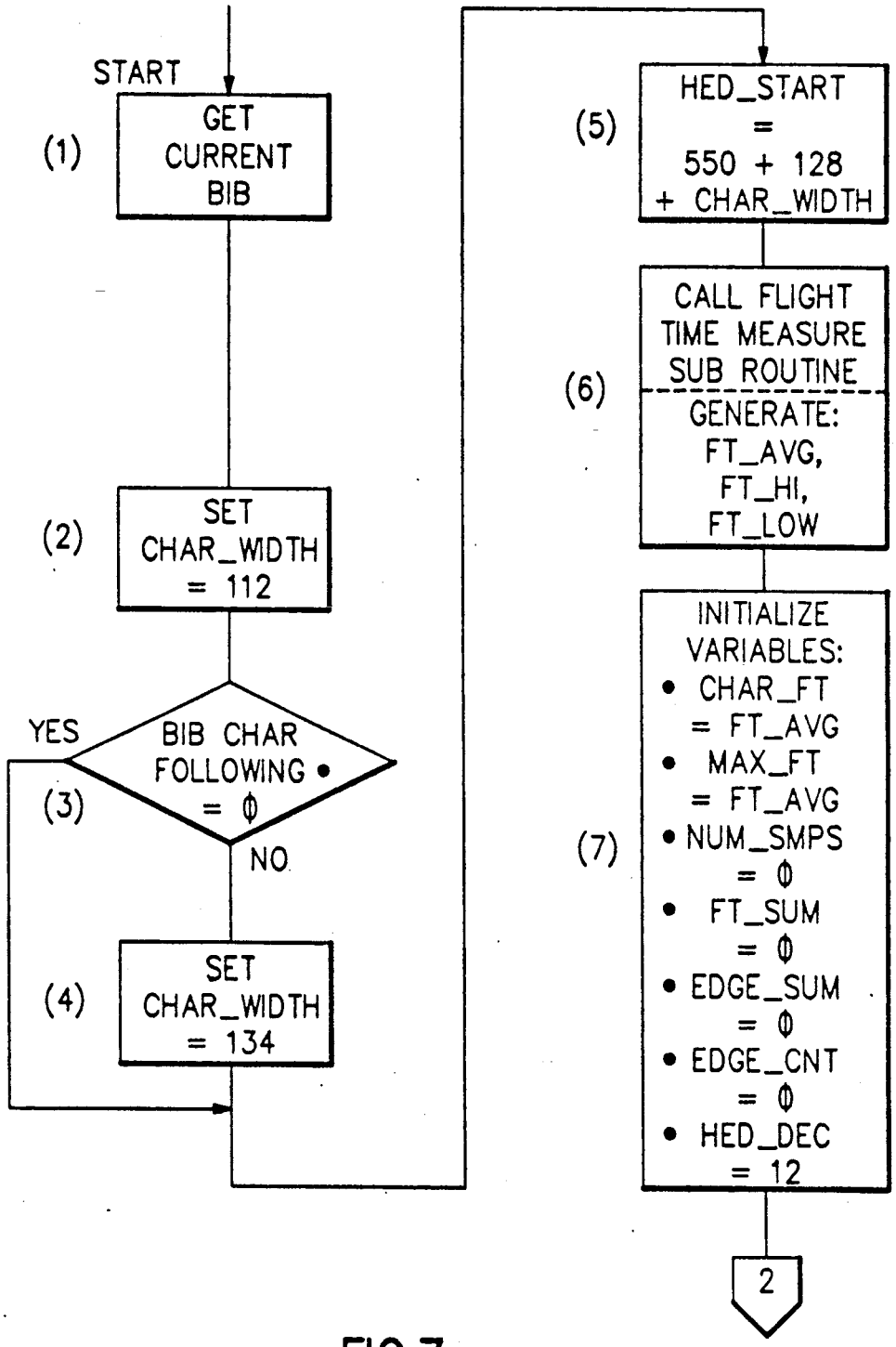
FIGS. 7, 8 and 9 comprise a flow chart for showing a specific embodiment of the operation of the control system described in FIG. 1.
Figure 8:
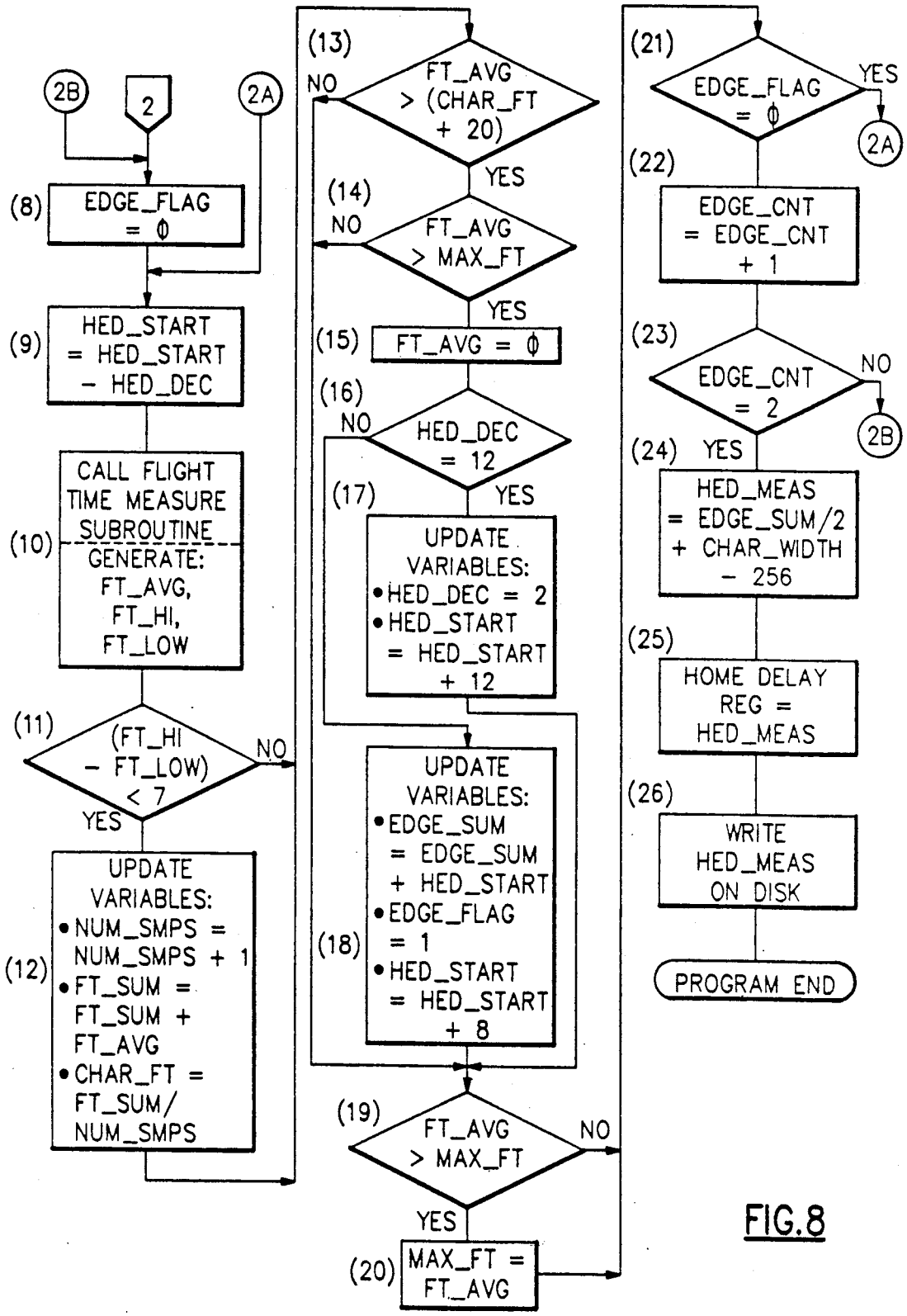

As seen in FIGS. 7 and 8, the microcode process for measuring and adjusting the Home Emitter Delay value is as follows:

1. The current image of band 10 in BIB is read into RAM 35,(1). If the BIB test character C following the period (.) is a zero (3), the character width (CHAR-WIDTH) is Set to 112 (2) otherwise it is set to 134 (4) where 112 & 134 represent a distance where a unit of distance is a fraction of a tick time interval.

2. The home emitter delay start value (HED-START) is calculated (5) as previously described. In the example shown, 550 is the true distance, 128 is the space between timing marks and CHAR-WIDTH=-½Hammer+½the width of the test character. Use of HED-START causes the test character to be struck by the test hammer when the period is addressed in the Print Line Buffer(PLB). To sense the edge of the test character, the test character must be struck near its center at the start. See FIG. 4.

3. Flight time is measured (6) using the initial home emitter delay value (HED-START). At this point (7) the test character flight time (CHAR-FT) and the (MAX-FT) are set equal to the average flight time measured (FT-AVG), the number of samples (NUM-SMPS) and flight time sum field (FR-SUM) used to calculate updated CHAR-FR are set to zero, the edge sum field (EDGE-HED) and the edge count (EDGE-CNT) fields are set to zero, and the home emitter delay decrement value (HED-DEC) is set to 12.

4. The edge detect flag (EDGE-FLAG) is set to zero (8).

5. The home emitter delay variable (HED-START) is decremented by the value of HED-DEC (9). This value is 12 until the edge is sensed the first time; thereafter, it is initialized to 2. Each decrement of home emitter delay causes the hammer to strike closer to the period, and eventually at the edge of the test character.

6. Flight time is measured (10) using the decremented home emitter delay value (HED-START).

7. If the difference between the lowest (FT-LOW) and the highest (FT-HI) flight time is less than 7(11) then the character flight time (CHAR-FT) is updated (12).

8. If the flight time average (FT-AVG) is greater than the character flight time (CHAR-FT) plus 20(13), and greater than the maximum flight (14), then, the character O edge is detected. The flight time average (FT-AVG) is set to zero(15) and the home emitter decrement value (HED-DEC) is tested (16). If it is equal to 12, then it is set to 2 and the home emitter delay value (HED-START) is incremented by 12 (17). This first edge detect is course and speeds up edge detection. Once detected, a fine decrement value is used to obtain the optimum results. If (HED-DEC) is equal to 2, the edge variables are updated (18). The edge sum field (EDGE-SUM) is set equal to the sum of EDGE SUM and the home emitter delay value (HED-START), the edge flag (EDGE-FLAG) is set to 1, and HED-START is set to HED-START plus 8. This is done for the second edge detection.

9. If the flight time average is greater than the maximum flight time (19) then the maximum flight time is set equal to the flight time average(20).

10. If the edge has not been sensed (21), the program continues searching beginning at step 5 (2A).

11. If the edge has been sensed, the edge count (EDGE-CNT) is incremented by one (22).

12. If the edge count does not equal 2, the program continues searching at step 4 (23)(2B).

13. If the edge count does equal 2, the test character edge has been sensed twice using a HED-DEC value of 2. The measured home emitter delay is calculated (24), set into RAM 35 for current use (25), written to the diskette drive 32 for future power-off/power-on initialization (26) and the program is ended.

Figure 9:
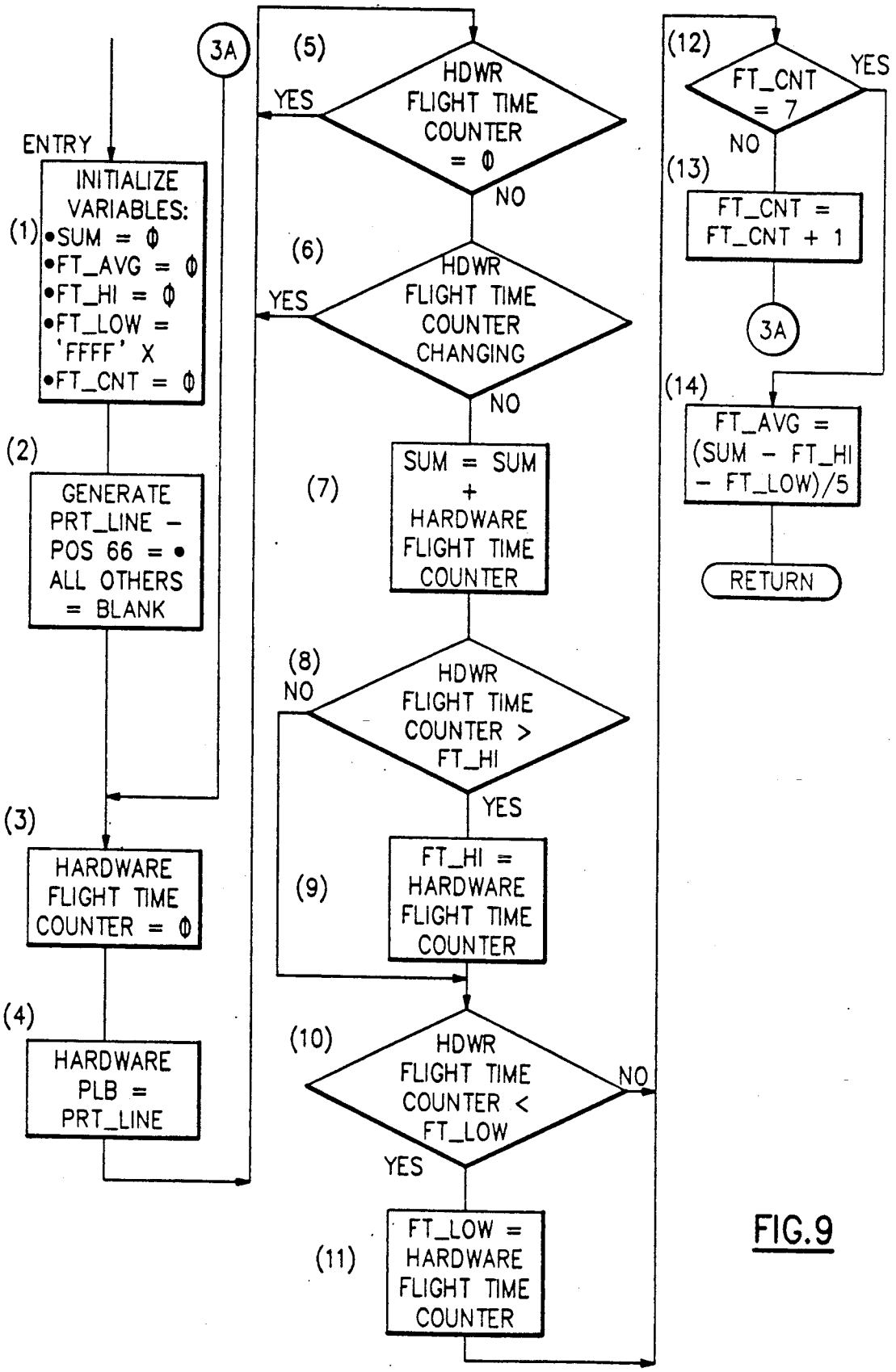

Referring to FIG. 9, a specific flight time measurement subroutine useful with the home delay and measurement program described is as follows:

1. The hammer flight sum field (SUM), flight time average (FT-AVG), flight time high (FT-HI), and flight time count field (FT-CNT) are set to zero; whereas the low flight time (FT-LOW) is set to hex FFFF, a number which is higher than any flight time measured.

2. Generate a print line (2) where position 66 is a period (.) and all remaining positions are null. It should be noted that flight time can be measured for any hammer. Position 66 was selected because of ready visibility while the program is running.

3. The flight time counter 39*a* is reset to zero (3).

4. The print line generated under step 2 is transferred to the hardware print line buffer (PLB) in RAM 35, see FIG. 1, which starts the printing process (4). A hammer set signal will start the flight time counter 39*a*. Hammer set occurs when the period is printed.

5. The program waits for the timer to start counting (5) and to stop incrementing (6). The counter is stopped when the hammer strike signal is received from platen 17 on line 18.

6. The flight time counter is added to the flight time sum field (SUM). This is done for seven measurements (7).

7. If the flight time counter is greater than the highest flight time (FI-HI) then FT-HI is set equal to the flight time counter (8,9).

8. If the flight time counter is less than the lowest flight time (FT-LOW) then FT-LOW is set equal to the flight time counter (10,11).

9. If flight time has not been measure seven times (12) then the flight time count (FT-CONT) is incremented, and flight time measurement continues at step 3 (13).

10. If flight time has been measured seven times (12) then flight time average is calculated and control is returned to the subroutine caller.

From the foregoing it can be appreciated that a process and system for making home adjustments have been provided which is automatic and is very accurate. Except for the initial operation of the keys on op panel 33 to select the program, no operator involvement is required and manual intervention in the actual adjustment of the home delay is eliminated.

While the invention has been particularly shown and described with reference to a preferred embodiment thereof, it will be understood by those skilled in the art that various changes in form and details may be made therein without departing from the spirit and scope of the invention.

What is claimed is:

1. In a printer system wherein a printer mechanism comprises type elements movable relative to a plurality of print hammers electrically operable for impacting said type elements during motion thereof for printing imprints of said type elements on a print medium and a print control with timing means including sensor means located at a home position relative to a particular print hammer and operable for generating timing signals for operating the hammers in synchronism with said the motion of said type elements, a method for compensating for inaccuracies in the location of said sensor means at said home position comprising the steps of operating a particular hammer to locate the edge of a particular type element during motion thereof, and deriving a time adjustment value on the basis of the distance said edge is from the center of said particular type element, and supplying said adjustment value to said print control for adjusting the timing of the operation of said print hammers in synchronism with the motion of said type elements.

2. In a printer system in accordance with claim 1, wherein said method of operation of said particular hammer to locate the edge of said particular type element comprises operating said particular hammer to produce impacts of said particular character and an adjacent space, detecting impacts of said particular hammer with said particular character and with said adjacent space, and differentiating between said impacts of said particular character from impacts of said space to locate said edge of said character.

3. In a printer system in accordance with claim 2, wherein said differentiating includes measuring the flight times of said particular hammer during operations which impact said particular character and which impact said adjacent space and locating the edge of said character on the basis of the measurement of said flight times.

4. In a printer system in accordance with claim 3, wherein said operating of said particular hammer includes selecting a first timing value for operating said hammer, then altering the timing value incrementally to cause said hammer to impact said particular character at progressively different points on said character and then said adjacent space to locate said edge of said character.

5. In a printer system in accordance with claim 4, wherein said altering of said timing value incrementally includes altering said timing value in large increments in one direction until said hammer impacts said adjacent space, followed by altering said timing value in the reverse direction until said hammer again impacts said character, and then altering said timing value with smaller increments again in said one direction until said hammer again impacts said adjacent space.

6. A printer system wherein a printer mechanism comprises type elements movable relative to a plurality of print hammers electrically operable for impacting said type elements during motion thereof for printing imprints of said type elements on a print medium, print control means for timing the selective operation of said hammers including means for generating timing signals including a home signal in synchronism with said motion of said type elements and including sensor means located at a home position which is a fixed distance relative to a particular hammer, and means for compensating for inaccuracies in the location of said sensor means at said home position comprising hammer control means for operating said particular hammer to locate an edge of a particular one of said type elements during motion thereof, and means for deriving a timing adjustment value on the basis of the distance said edge of said particular one of type elements is from its center for use by said hammer control means in timing the operations of said hammers to effect said printing.

7. A printer system in accordance with claim 6 wherein said printer mechanism includes a type band and said type elements comprise uniformly spaced characters formed thereon, said hammer control means operates said particular hammer to produce impacts of a particular character and an adjacent space, impact detection means for detecting impacts of said particular character and of said adjacent space, and said means for deriving said timing adjustment value includes means for differentiating between said impacts of said particular character and of said adjacent space.

8. A printer system in accordance with claim 7 wherein said particular character is a wide character, and said adjacent space is between said wide character and an adjacent character.

9. A printer system in accordance with claim 8 wherein said adjacent character is a small character such as a period.

10. A printer system in accordance with claim 7 wherein said adjacent space comprises a blank character on said type band.

11. A printer system in accordance with claim 7 wherein said impact detection means includes a transducer platen for generating impact signals to said print control means in response to impacts of said particular character or said adjacent space of said band.

12. A printer system in accordance with claim 11 wherein said means for differentiating impacts of said particular character from impacts of said adjacent space includes means responsive to said impact signals produced by said transducer platen for measuring the flight times of said particular hammer resulting from impacts of said particular character or said space.

13. A printer system in accordance with claim 11 wherein said means for deriving said timing adjustment value and measuring said flight times of said particular hammer includes microprocessor and programming means for incrementally altering the timing of said particular hammer to produce a plurality of impacts of said particular character and of said adjacent space, for computing flight time averages to locate said edge of said particular character and for computing a time adjustment value based on the distance of between said edge and the center of said particular character.

* * * * *